US005582959A

United States Patent [19]

Ito

[11] Patent Number: 5,582,959

[45] Date of Patent: Dec. 10, 1996

[54] METHOD FOR FORMING AN IMAGE

[75] Inventor: Tadashi Ito, Kanagawa, Japan

[73] Assignee: Fuji Photo Film Co., Ltd., Kanagawa, Japan

[21] Appl. No.: 485,141

[22] Filed: Jun. 7, 1995

Related U.S. Application Data

[63] Continuation of Ser. No. 270,417, Jul. 5, 1994, abandoned, which is a continuation of Ser. No. 87,315, Jul. 8, 1993, abandoned.

[30] Foreign Application Priority Data

Jul. 22, 1992 [JP] Japan ..... 4-195314

[51] Int. Cl.[6] ..... G03C 5/31

[52] U.S. Cl. ..... 430/434; 430/464; 430/527; 430/530; 430/945

[58] Field of Search ..... 430/363, 393, 430/527, 530, 533, 534, 535, 536, 639, 945, 947, 950, 434, 464

[56] References Cited

U.S. PATENT DOCUMENTS

| | | | |
|---|---|---|---|
| 4,394,441 | 7/1983 | Kawaguchi et al. | 430/527 |
| 4,416,963 | 11/1983 | Takimoto et al. | 430/527 |
| 4,418,141 | 11/1983 | Kawaguchi et al. | 430/530 |
| 4,495,276 | 1/1985 | Takimoto et al. | 430/527 |
| 4,999,276 | 3/1991 | Kuwabara et al. | 430/527 |
| 5,071,736 | 12/1991 | Ikenoue et al. | 430/523 |
| 5,122,445 | 6/1992 | Ishigaki | 430/527 |
| 5,187,514 | 2/1993 | Ikenoue | 354/275 |
| 5,198,328 | 3/1993 | Shiba et al. | 430/363 |
| 5,217,855 | 6/1993 | Okada et al. | 430/393 |
| 5,219,718 | 6/1993 | Hatakeyama et al. | 430/527 |
| 5,238,800 | 8/1993 | Hosoi et al. | 43/527 |
| 5,238,801 | 8/1993 | Ishigaki et al. | 430/530 |
| 5,254,448 | 10/1993 | Yamada et al. | 430/527 |
| 5,260,176 | 11/1993 | Otani et al. | 430/363 |

*Primary Examiner*—Hoa Van Le

*Attorney, Agent, or Firm*—Sughrue, Mion, Zinn, Macpeak & Seas

[57] ABSTRACT

An image-forming method comprising processing an image-wise exposed silver halide photographic material for a laser scanner comprising a transparent support having thereon at least one silver halide emulsion layer comprising a silver halide emulsion having a silver chloride content of ≧90 mol % spectrally sensitized to a range of ≧600 nm. Processing comprises developing in a developing bath and fixing in a fixing bath, wherein the photographic material contains one or both of a conductive metal oxide and a conductive polymer; the developing bath and the fixing bath are each replenished in an amount of ≦200 ml per $m^2$ of the photographic material processed; the processing is carried out in an automatic developing machine. Further, an image-forming method, wherein the photographic material contains a polyoxyethylene nonionic surface active agent and a fluorine-containing surface active agent each having a solubility of ≦0.01% by weight in the developing bath, the fixing bath and water at 35° C.; the developing bath and the fixing bath are each replenished in an amount of ≦200 ml per $m^2$ of the photographic material processed; and the processing is carried out in an automatic developing machine.

9 Claims, No Drawings

METHOD FOR FORMING AN IMAGE

This is a continuation of application Ser. No. 08/270,417, filed Jul. 5, 1994, which is a continuation of application Ser. No. 08/087,315, filed Jul. 8, 1993, now abandoned.

FIELD OF THE INVENTION

The present invention relates to a method for forming an image with a silver halide photographic material for a laser scanner with an automatic developing machine, and more specifically to a method for forming an image in which the replenishing amount of developing solution per unit area of a processed photographic material is reduced and stable photographic performance is obtained.

BACKGROUND OF THE INVENTION

In general, an imagewise exposed black and white silver halide photographic material is processed by the steps of developing, fixing, rinsing (or washing) and drying. Recently, the photographic material (i.e., the light-sensitive material) is almost always processed with an automatic developing machine. In this case, the light-sensitive material is usually subjected to development processing while replenishing a fixed amount of developing solution proportional to the area of the light-sensitive material processed. Stable photographic performance is desired when such the development processing is carried out. Furthermore, investigators have sought to reduce the replenishing solution amount while maintaining stable photographic performance. Generally, the developing solution is replenished in an amount of 250 ml or more, particularly 330 ml or more per $m^2$ of a sheet form photographic material processed such as, for example, an X-ray photographic material and a graphic arts light-sensitive material.

However, the photographic developing solution waste liquid has a high chemical oxygen demand (C.O.D.) or biological oxygen demand (B.O.D). Consequently, the developing solution waste liquid is disposed only after it is first subjected to chemical or biological treatment to render the same environmentally harmless. Because waste treatment is expensive, there is a need for a developing method in which the replenishing amount to the developing solution is further reduced.

On the other hand, a scanner system is known as a method for imagewise exposing a photographic material. In the scanner system, an original picture is scanned and a silver halide photographic light-sensitive material is exposed according to the image signals obtained therefrom to form a negative image or positive image corresponding to the image on the original picture. Various recording equipment employing a scanner system is commercially available, and a laser having a wavelength of 600 nm or more is often used as one of the recording light sources for such scanner system recording equipment.

In general, a photographic light-sensitive material comprises a support and a photographic layer each having an electrical insulating characteristic. Thus, an electrostatic charge is accumulated in many cases by contact friction with the surface of the same kind or different kind of material, or by peeling during the manufacture or use of the photographic light-sensitive material. This accumulated electrostatic charge causes many problems. A serious problem in particular is a dotlike spot or a dendritic or plumous line speckle that is generated when a light-sensitive emulsion layer of the photographic film is exposed by discharge of an accumulated electrostatic charge and then subjected to development processing. Furthermore, these accumulated charges induce secondary problems such as sticking of dust to a film surface, inferior transport in photographing and in a film carrier, and uneven coating.

In a scanner system employing a laser, rapid and accurate film transport is essential. Inferior transport caused by static electricity leads to inaccurate images, which in turn results in a wrong decision made based on the inaccurate images. An anti-static agent is usually added to a photographic material as a countermeasure therefor. However, the above described reduction in the replenishing amount of a processing solution allows the anti-static agent contained in the photographic material to be eluted to the processing solution. As a result, the accumulated amount thereof in the processing solution is increased and the anti-static agent is deposited onto the photographic material as an insoluble matter. This deposit generates stain (a scurf-like stain) and foaming in a developing solution and a fixing solution, which in turn leads to deteriorated developing and fixing characteristics.

Thus, there is a need in the art for an image-forming method in which the replenishing amounts of a developing solution and a fixing solution can be reduced, while stable photographic performance is obtained.

SUMMARY OF THE INVENTION

A first object of the present invention is to provide a method for forming an image in which the replenishing amounts of a developing solution and a fixing solution per unit area are reduced in processing a silver halide photographic material for a laser scanning system with an automatic developing machine.

Another object of the present invention is to provide a method as described above having stable photographic performance, even with reduced replenishing amounts of the developing solution and fixing solution.

The above objects of the present invention have been achieved by a method for forming an image comprising processing an imagewise exposed silver halide photographic material for a laser scanner comprising a transparent support having thereon at least one silver halide emulsion layer comprising a silver halide emulsion having a silver chloride content of 90 mol % or more spectrally sensitized to a wavelength range of 600 nm or more, and the processing comprises developing in a developing bath and fixing in a fixing bath, wherein the photographic material contains one or both of a conductive metal oxide and a conductive polymer; the developing bath and the fixing bath are each replenished in an amount of 200 ml or less per $m^2$ of the photographic material processed; and the processing is carried out in an automatic developing machine.

The objects of the present invention have also been achieved by a method for forming an image comprising processing an imagewise exposed silver halide photographic material for a laser scanner comprising a transparent support having thereon at least one silver halide emulsion layer comprising a silver halide emulsion having a silver chloride content of 90 mol % or more spectrally sensitized to a wavelength range of 600 nm or more, and the processing comprises developing in a developing bath and fixing in a fixing bath, wherein the photographic material contains a polyoxyethylene nonionic surface active agent and a fluorine-containing surface active agent each having a solubility of 0.01% by weight or less in the developing bath, the fixing bath and water at 35° C.; the developing bath and the fixing bath are each replenished in an amount of 200 ml or less per $m^2$ of the photographic material processed; and the processing is carried out in an automatic developing machine.

DETAILED DESCRIPTION OF THE INVENTION

The high silver chloride content emulsion contained in the photographic emulsion layer of the photographic material for use in the present invention is one of silver bromochloride, silver chloroiodide or silver bromochloroiodide each having silver chloride content of 90 mol % or more (as an average value), or silver chloride. The silver iodide content is preferably 1 mol % or less. Particularly preferred is silver bromochloride having a silver chloride content of 96 mol % or more (as an average value), or silver chloride.

This is because of the following reason.

The reduction in replenishing amount of a developing solution requires a reduction in the coated amount of a silver halide emulsion. However, simple reduction thereof lowers the maximum blackening density after processing. It is known that a decrease in the grain size of the silver halide emulsion suffices for solving this. However, the silver tone after processing is yellowed, and it is not particularly suited for medical use. It is shown in Japanese Patent Application No. 4-107887 that the silver halide emulsion having a silver chloride content of at least 90 mol % can prevent yellowing of the silver tone after the processing. Thus, decrease in the replenishing amount of the developing solution and prevention of the yellowing of the silver tone after processing require a silver chloride content in the silver halide of at least 90 mol %.

Furthermore, the silver halide grains of the high silver chloride content emulsion for use in the present invention preferably comprise a silver bromide-localized phase in which the silver bromide content is relatively high compared with that in the remainder of the grain.

Preferably, the localized silver bromide phase is present on the surface of the silver halide grains or in the inside thereof close to the surface, and particularly preferably exists at the edge portion and corner portion on the crystal surface of the grains or on a crystal face in the form of a protrusion. The silver bromide content of the silver bromide localized phase is generally form 10 mol % to 95 mol %, preferably from 15 mol % to 90 mol %, more preferably from 20 mol % to 60 mol %, and most preferably from 30 mol % to 60 mol % or less.

The remaining silver halide in the localized silver bromide phase preferably comprises silver chloride, and further a trace amount of silver iodide may be contained, provided that the overall silver iodide content does not exceed 1 mol % (for the entire emulsion) as described above.

The localized silver bromide phase preferably constitutes from 0.03 mol % to 10 mol %, more preferably from 0.1 mol % to 5 mol % of the entire amount of silver halide constituting the silver halide grains contained in the emulsion.

The localized silver bromide phase need not consist of a single halogen composition, and may comprise two or more localized phases each having a different silver bromide content, or the boundary present between the localized silver bromide phase and the other phases may be such that the halogen composition thereof is continuously varied (i.e., the change in silver halide composition between different phases need not be an abrupt change).

The above described localized silver bromide phase can be formed (i) by reacting a water soluble silver salt and a water soluble halide including a water soluble bromide with an emulsion containing silver chloride grains or high silver chloride content grains previously formed by the double jet method to precipitate silver bromide thereon; (ii) by converting a part of the emulsion containing the silver chloride grains or high silver chloride content grains previously formed to a silver bromide-rich phase using a halogen conversion method well known to those of ordinary skill in the art; or (iii) by adding fine silver bromide grains or high silver bromide content fine grains each having a smaller grain size than those of the silver chloride grains or high silver chloride content grains and other sparingly soluble silver salts to recrystallize silver bromide on the surface of the silver chloride grains or high silver chloride content grains.

Such preparation methods are described, for example, in European Patent Publication 0,273,430A2.

The silver bromide content of the localized phase can be determined with an X-ray diffraction method (described, for example, in *New Experimental Chemical Course* 6, *Structural Analysis* edited by Japan Chemical Society, Maruzen) or an XPS method (described, for example, in *Surface Analysis, -IMA, Application of Auger Electron/Photoelectron Spectrometry-*, Kohdansha). Also, the localized silver bromide phase can be observed using an electron microscope or the method described in above noted European Patent Publication 0,273,430A2.

Among the above described methods, a particularly useful method for forming the localized silver bromide phase in the present invention comprises forming silver bromide and/or silver bromochloride on the surface of high silver chloride content grains during chemical ripening. This technique is preferred for obtaining high sensitivity and low fog.

The effects of the present invention are enhanced by incorporating metal ions other than silver ion (for example, the metal ions of Group VIII, the transition metal ions of Group II, the read ions of Group IV and the metal ions of Group I, of the periodic table, and a copper ion) or complex ions thereof into the silver halide grains for use in the present invention.

The metal ions other than silver ion is preferably used in an amount of $1\times10^{-8}$ to $1\times10^{-4}$ mol per mol of the silver halide.

These metal ions or complex ions thereof may be uniformly incorporated into the entire silver halide grain, or the above described localized silver bromide phase, or other phases.

Among the above metal ions or complex ions thereof, particularly useful are those selected from iridium ion, palladium ion, rhodium ion, zinc ion, iron ion, platinum ion, gold ion, and copper ion. The combined use of these metal ions or complex ions thereof rather than the single use thereof can provide the desired photographic characteristics in many cases. In particular, the kinds and addition amounts of the ions are varied depending on the portion of the grain or phase in which the ions are introduced. Iridium ion, iron ion and rhodium ion are particularly preferably incorporated into the localized silver bromide phase.

The metal ions or complex ions thereof may be incorporated into the localized silver bromide phase and/or other portions of the silver halide grain by adding these metal ions or complex ions thereof directly into a reaction vessel before or during the formation of the silver halide grains, or during physical ripening after grain-formation, or they may be added directly to the aqueous solution of a water soluble halide or a water soluble silver salt which are reacted to form the silver halide grains. When the localized silver bromide phase is formed with silver bromide fine grains or high silver bromide content fine grains, the metal ions or complex ions thereof may be incorporated into the silver bromide fine grains or high silver bromide content fine grains in a similar manner as described above and then the obtained fine grains containing the metal ions or complex ions thereof are added to a silver chloride or high silver chloride content emulsion. The metal ions may be incorporated while forming the localized silver bromide phase by adding relatively scarcely soluble bromides of the above metal ions (other than silver), for example, in the form of a solid matter or powder.

The silver halide emulsion according to the present invention preferably contains silver halide grains having a (100) face/(111) face ratio of generally 5 or more, preferably 10 or more in a proportion of preferably 50 wt % or more, more preferably 60 wt % or more, and most preferably 80 wt % or more of the silver halide grains constituting the emulsion.

The size of the silver halide grains for use in the present invention is generally 0.4 μm or less, preferably 0.35 μm or less, and more preferably 0.05 to 0.3 μm.

Smaller size grains are preferred for reducing the silver/binder ratio, to thereby obtain high covering power.

The size distribution of the silver halide grains may be either broad or narrow. A monodispersed emulsion is preferred for providing enhanced photographic characteristics such as latent image stability and pressure resistance, and for providing improved processing stability such as less variation in photographic characteristics with a change in developing solution pH. The value S/d obtained by dividing the standard deviation S in the distribution of the diameter of a circle to which the projected area of a silver halide grain is converted with the average grain diameter is preferably 20% or less, more preferably 15% or less.

The silver chloride, silver bromochloride or silver bromochloroiodide emulsion for use in the present invention can be prepared by the methods described in *Chemie et Phisigue Photographigue* written by P. Glafkides (published by Paul Montel Co., Ltd., 1967), *Photographic Emulsion Chemistry* written by G. F. Duffin (published by Focal Press Co., Ltd., 1966), and *Making and Coating of Photographic Emulsion* written by V. L. Zelikman (published by Focal Press Co., Ltd., 1964). Namely, the silver halide emulsion may be prepared by any of an acid method, a neutral method and an ammonia method. In particular, the acid method and neutral method are preferred in the present invention for decreasing fog. Any of a single jet method, a double jet method and combinations thereof can be used for reacting a water soluble silver salt with a water soluble halide to obtain a silver halide emulsion. The reverse mixing method can also be used in which the grains are formed under conditions of excess silver ion. The double jet method is preferably used for obtaining a monodispersed emulsion, in which the emulsion is preferred in the present invention. A more preferred form of the double jet method is one in which the silver ion concentration of the solution in which the silver halide grains are formed is maintained constant; namely, the controlled double jet method. Using this method, a silver halide emulsion having a regular crystal form and a narrow grain size distribution can be obtained which is preferred in the present invention.

A cadmium salt, a zinc salt, a lead salt, a thallium salt, the above iridium salt or complex salts thereof, a rhodium salt or complex salt thereof, and an iron salt or complex salt thereof may be present during grain formation or physical ripening of the silver halide emulsion.

A silver halide solvent (for example, known silver halide solvents such as ammonia, thiocyanate, and thioethers and the thione compounds described in U.S. Pat. No. 3,271,157, JP-A-51-12360 (the term "JP-A" as used herein means an "unexamined published Japanese patent application"), JP-A-53-82408, JP-A-53-144319, JP-A-54-100717, and JP-A-54-155828) may be used during or after grain formation, and the combined use thereof with the above method can provide a silver halide emulsion having a regular silver halide crystal form and a narrow grain size distribution, which is preferred in the present invention.

In order to remove soluble salts from an emulsion after physical ripening, a noodle method, a flocculation method or a ultrafiltration method can be utilized.

The emulsion for use in the present invention can be chemically sensitized by the single or combined use of selenium sensitization, reduction sensitization and noble metal sensitization. That is, there can be used singly or in combination, a sulfur sensitization method employing active gelatin and a compound including a sulfur compound capable of reacting with silver ion (for example, thiosulfate, a thiourea compound, a mercapto compound and a rhodanine compound), a reduction sensitization method employing a reductive material (for example, a stannous salt, amines, a hydrazine derivative, formamidinesulfinic acid, and a silane compound), and a noble metal sensitization method employing a metal compound (for example, the above described gold complex salt, and the salts of the metals of Group VIII of the periodic table, such as platinum, iridium, palladium, rhodium, and iron). In the emulsion according to the present invention, sulfur sensitization or selenium sensitization is preferably used, and gold sensitization is furthermore preferably used in combination therewith. Further, during chemical sensitizations, a hydroxyazaindene compound or nucleic acid is preferably present in order to control sensitivity and gradation.

In the present invention, the silver halide emulsion having a silver chloride content of 90 mol % or more is spectrally sensitized to a wavelength range of 600 nm or more by use of appropriate spectral sensitizing dyes.

Preferred spectral sensitizing dyes having a (maximum) wavelength sensitivity in the range of 600 nm or more for use in the present invention include the sensitizing dyes described in JP-A-3-11336, JP-A-64-40939, JP-A-2-266934, JP-A-3-121798, JP-A-3-228741, JP-A-3-266959, and JP-A-3-311498.

These spectral sensitizing dyes may be used either singly or in combination thereof. A combination of sensitizing dyes is often used particularly for supersensitization. There may be incorporated into an emulsion together with the spectral sensitizing dyes, a dye which by itself has no spectral sensitizing action or a material which absorbs substantially no visible light and provide a supersensitization effect.

Combinations of useful spectral sensitizing dyes, and dyes which provide supersensitization and materials which provide supersensitization are described in *Research Disclosure* vol. 176, No. 17643 (published in December 1978), pp. 23, item J in IV, JP-B-49-25500 (the term "JP-B" as used herewith means an examined Japanese patent publication) and JP-B-43-4933, and JP-A-59-19032 and JP-A-59-192242.

The optimum addition amount of the spectral sensitizing dye having a maximum wavelength sensitivity of 600 nm or more according to the preset invention depends on the grain size of the silver halide emulsion, halogen composition, the method and degree of chemical sensitization, the relationship of the layer into which the subject spectral sensitizing dye is incorporated with the silver halide emulsion, and the kind of anti-fogging compound employed. The optimum addition amount is readily determined by those of ordinary skill in the art. The addition amount of the spectral sensitizing dyes is generally in the range of from $10^{-7}$ to $1\times10^{-2}$ mol, particularly $1\times10^{-6}$ to $5\times10^{-3}$ mol per mol of silver halide.

Various compounds can be incorporated into the light-sensitive material of the present invention for preventing fog in preparation, storage and photographically processing a light-sensitive material and stabilizing photographic performance. These additives include compounds known as anti-fogging agents and stabilizers, for example, azoles such as a benzothiazolium salt, nitroindazoles, chlorobenzimidazoles, bromobenzimidazoles, mercaptotetrazoles, mercaptothiazoles, mercaptobenzothiazoles, mercaptothiadiazoles, aminotriazoles, benzothiazoles, and nitrobenzotriazoles; mercaptopyrimidines; mercaptotriazines; thioketo compounds such as oxazolinethione; azaindenes such as triazaindenes and tetraazaindenes (particularly 4-hydroxy substituted (1,3,3a,7) tetraazaindenes), and pentaazaindenes; benzenesulfonic acid and benzenesulfinic acid; and benzenesulfonic acid amide. Of these compounds, preferred are benzotriazoles (for example, 5-methylbenzotriazole) and nitroindazoles (for example, 5-nitroindazole). These compounds may be contained in a processing solution. Furthermore, the compounds described in JP-A-62-30243 which release an inhibitor during development can be incorporated as a stabilizer.

A developing agent such as a hydroquinone derivative and a phenidone derivative can be incorporated into the photographic material of the present invention as a stabilizer and an accelerator.

An inorganic or organic hardener may be incorporated into a photographic emulsion layer or the other hydrophilic colloid layers of the photographic material of the present invention. There can be used singly or in combination, for example, a chromium salt (chromium alum and chromium acetate), aldehydes (formaldehyde and glutaraldehyde), an N-methylol compound (dimethylolurea), a dioxane derivative, an active vinyl compound (1,3,5-triacryloyl-hexahydro-s-triazine and 1,3-vinylsulfonyl-2-propanol), an active halogen compound (2,4-dichloro-6-hydroxy-s-triazine), and mucohalogenic acid (mucochloric acid).

A water soluble dye may be incorporated into a hydrophilic colloid layer of the photographic material of the present invention as a filter dye or for antiirradiation and other purposes. Useful dyes for this purpose include an oxonol dye, a hemioxonol dye, a styryl dye, a merocyanine dye, a cyanine dye, and an azo dye. Of them, an oxonol dye, hemioxonol dye and merocyanine dye are preferred.

The transparent support for the photographic material of the present invention has a thickness of from 150 to 250 μm in the case of photographic materials for medical use. This is essential for handling performance in observing on a light table for medical use. The material of the support is preferably a polyethylene terephthalate film, and the support is particularly preferably colored blue.

The surface of the support is preferably subjected to corona discharge treatment, glow discharge treatment or UV irradiation treatment in order to improve adhesion with a hydrophilic colloid layer. Further, a subbing layer may be provided, comprising a styrenebutadiene series latex and a vinylidene chloride series latex, and a gelatin layer may further be provided thereon.

Furthermore, a subbing layer may be provided by coating an organic solvent containing a polyethylene swelling agent and gelatin.

A surface treatment can be applied to these subbing layers to improve the adhesive force thereof with a hydrophilic colloid layer.

The entire amount of gelatin coated on a silver halide emulsion layer-containing side of the support (i.e., per each side of the support) according to the present invention is preferably 3.5 g/m$^2$ or less, more preferably 3.3 g/m$^2$ or less, most preferably 1 to 3.0 g/m$^2$.

The coated Ag amount of the silver halide emulsion per each side of the support according to the present invention is preferably 2.6 g/m$^2$ or less, more preferably 2.3 g/m$^2$ or less, most preferably 0.5 to 2.0 g/m$^2$.

Further, the weight ratio of silver to gelatin contained in a silver halide emulsion layer is an important factor for rapid processing aptitude. An increase in the silver/gelatin ratio of the silver halide emulsion layer tends to damage the silver halide photographic material by peeling of the emulsion layer during transport with a roller in processing with an automatic developing machine, to make the so-called "emulsion pick off", in which the image is not clear. Thus, the silver/gelatin weight ratio of the silver halide emulsion layer is preferably 1.4 or less, more preferably 1.2 or less and most preferably 0.5 to 1.1.

The anti-static agent for use in the present invention is described below, provided that the anti-static agent for use in the present invention does not include conventional water-soluble anti-static agents.

First, a conductive material preferably used as the anti-static agent is a crystalline metal oxide grain. Generally, grains having an oxygen deficiency and those containing a small amount of a different kind of atom which serves as a donor to the metal oxide have high conductivity and therefore are particularly preferred. In particular, the latter is particularly preferred since it does not fog a silver halide emulsion. Preferred examples of the metal oxide include ZnO, $TiO_2$, $SnO_2$, $Al_2O_3$, $In_2O_3$, $SiO_2$, MgO, BaO, $MoO_3$, $V_2O_5$, and composite oxides thereof. ZnO, $TiO_2$ and $SnO_2$ are particularly preferred. Effective examples of the metal oxides containing different kinds of atoms include, for example, ZnO containing A1 and/or In; $SnO_2$ containing Sb, Nb, P and/or a halogen atom; and $TiO_2$ containing Nb and/or Ta. The addition amount of these different kinds of atoms is preferably in the range of 0.01 to 30 mol %, particularly preferably 0.1 to 10 mol %.

Furthermore, in order to improve a fine grain dispersibility and a transparency, a silicon compound may be added in forming the fine grains.

The metal oxide fine particles according to the present invention have a volume resistivity of preferably 107 Ω.cm or less, particularly preferably 105 Ω.cm or less.

These oxides are described in JP-A-56-143431, JP-A-4 56-12051 and JP-A-58-62647.

Further, conductive materials prepared by depositing the above described metal oxides on other crystalline metal oxides particles or fibrous materials (for example, titanium oxide) may be used, as described in JP-B-59-6235.

The particle size of the metal oxide fine particles is preferably 1 μm or less. A particle size of 0.5 μm or less improves stability after dispersing and therefore improves handleability. The use of conductive particles having a particle size of 0.3 μm or less for reducing the light scattering property thereof is preferred because it allows for preparation of a transparent light-sensitive material.

Furthermore, where the conductive materials are in the form of a needle or fiber, the length thereof is preferably 30 μm or less and the diameter thereof is preferably 1 μm or less. Particularly preferably, the length is 10 μm or less, the diameter is 0.3 μm or less, and the ratio of length/diameter is 3 or more.

These metal oxides having good conductivity according to the present invention may be coated from a coating solution without a binder. In this case, a binder is preferably further coated thereon.

The metal oxides according to the present invention are preferably coated together with a binder. The binder is not particularly limited. Useful binders include water soluble binders such as gelatin, dextran, polyacrylamide, starch, and polyvinyl alcohol. For use with an organic solvent, other useful binders include synthetic polymer binders such as poly(meth)acrylic acid ester, polyvinyl acetate, polyurethane, polyvinyl chloride, polyvinylidene chloride, a styrene/butadiene copolymer, polystyrene, polyester, polyethylene, polyethylene oxide, polypropylene, and polycarbonate. Furthermore, these polymer binders may be used in the form of an aqueous dispersion.

Furthermore, these metal oxides may be used as a mixture of a spherical form and a fiber form.

The content of the metal oxide according to the present invention is preferably 0.00051 g/m$^2$ or more, more preferably 0.0009 to 0.5 g/m$^2$, and most preferably 0.0012 to 0.3 g/m$^2$ of the photographic material.

Furthermore, a heat resisting agent, a weather resisting agent, inorganic particles, a water soluble resin, and an emulsion may be added to the layer containing the metal oxide according to the present invention for matting and improving film quality, so long as the effects of the present invention are still obtained.

For example, inorganic fine particles may be incorporated into the layer containing the metal oxide according to the present invention. Examples of the inorganic fine particles include silica, colloidal silica, alumina, alumina sol, kaolin, talc, mica, and calcium carbonate. The inorganic fine particles have an average particle size preferably of from 0.01 to 10 μm, more preferably from 0.01 to 5 μm, and the addition amount thereof is preferably 0.05 to 10 times, particularly preferably 0.1 to 5 times in terms of a weight ratio based on the entire solid content of a coating solution.

Next, the conductive polymer (including conductive latexes) for use in the present invention is described below. The conductive polymers (including latexes) are not particularly limited, and include anionic, cationic, betainic, and nonionic polymers. Of these, anionic and cationic polymers are preferred. More preferred are sulfonic acid series, carboxylic acid series, and phosphoric acid series polymers or latexes, each of which is anionic. Also preferred are the tertiary amine series, quaternary ammonium series, and phosphonium series polymers. Examples of useful conductive polymers (including conductive latexes), for example, include the anionic series polymers and latexes described in JP-B-52-25251, JP-A-51-29923, JP-B-60-48024, and U.S. Pat. No. 4,701,403, and the cationic polymers and latexes described in JP-B-57-18176, JP-B-57-56059 and JP-B-58-56856, and U.S. Pat. No. 4,118,231.

Specific examples of conductive polymers and latexes for use in this invention are shown below, but the present invention should not be construed as being limited thereto.

P-1

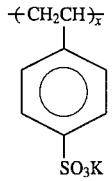

(Average Molecular Weight: 150,000)

P-2

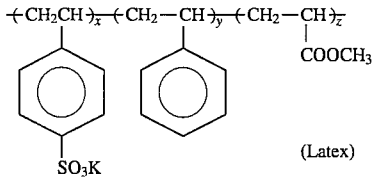

(Latex)

x:y:z = 25:60:15

P-3

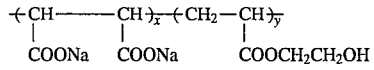

x:y = 70:30

(Average Molecular Weight: 45,000)

P-4

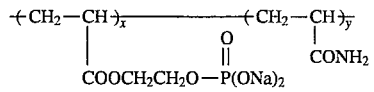

x:y = 50:50

(Average Molecular Weight: 12,000)

P-5

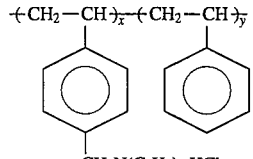

(Latex)

x:y = 30:70

P-6

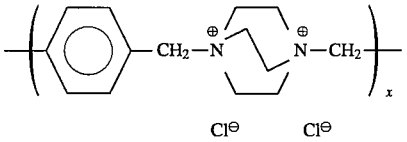

(Average Molecular Weight: 10,000)

P-7

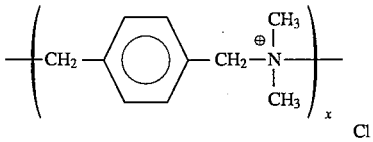

(Average Molecular Weight: 30,000)

These polymers or latexes having good conductivity for use in the present invention may be coated from a coating solution without a binder. In this case, a binder is preferably further coated thereon. The polymers or latexes having good conductivity for use the present invention are more preferably coated together with a binder. The binder is not particularly limited, and preferred binders are those described above for use in coating the metal oxide. Furthermore, a hardener can be used together with these binders, and the preferred examples thereof are the same as those described above.

The content of the polymers or latexes having good conductivity for use in the present invention is generally from 0.005 to 5 g/m$^2$, preferably 0.01 to 3 g/m$^2$, and more preferably 0.02 to 1 g/m$^2$. The content of the binder used to coat the polymer or latex is from 0.005 to 5 g/m$^2$, preferably 0.01 to 3 g/m$^2$, and particularly preferably 0.01 to 2 g/m$^2$ of the photographic material.

The weight ratio of the conductive polymer or latex to binder is generally 99:1 to 10:90, preferably 95:5 to 15:85, particularly preferably 90:10 to 20:80.

The layer to which the conductive metal oxide, polymer and latex are added is not particularly limited, and includes, for example, a protective layer, an intermediate layer, an emulsion layer, a UV layer, an anti-halation layer, a subbing layer, a back layer, and a back protective layer. Of these, preferred are a protective layer, intermediate layer, anti-halation layer, subbing layer, back layer, and back protective layer, and particularly preferred are the subbing layer, back layer, intermediate layer, and anti-halation layer.

The following method is also within the scope of this invention.

The photographic material of the present invention in this embodiment is characterized as containing at least one polyoxyethylene series nonionic surface active agent and a fluorine-containing surface active agent in at least one layer constituting the photographic material.

The polyoxyethylene series nonionic surface active agent for use in the present invention has a solubility of 0.01 weight % or less at 35° C. in a developing solution, a fixing solution and water which are used for processing the photographic material.

The polyoxyethylene series nonionic surface active agent for use in the present invention is described below.

The polyoxyethylene series nonionic surface active agent for use in the present invention is not particularly limited as long as the solubility thereof falls within the above described range. Examples thereof include a compound comprising a hydrophobic portion having an alkyl group, an alkenyl group or an allyl group each having 12 or more carbon atoms and a hydrophilic portion having a polyoxyethylene group with a polymerization degree of 5 or more. More preferred is a compound comprising a hydrophobic portion having an alkyl group, an alkenyl group or an allyl group each having 16 or more carbon atoms and a hydrophilic portion having a polyoxyethylene group with a polymerization degree of from 7 to 30.

These polyoxyethylene series nonionic surface active agents can be prepared by conventionally known synthetic methods. Representative examples of the surface active agents include polyoxyethylenealkyl (alkenyl, allyl) ethers, polyoxyethylenealkyl (alkenyl, allyl)acid esters, polyoxyethylenealkyl (alkenyl, allyl)amines or amides, and polyoxyethylenes of silicon.

Specific non-limiting examples of the polyoxyethylene series nonionic surface active agent for use in the present invention are shown below.

$C_{18}H_{37}O(CH_2CH_2O)_6COCH_3$ Q-1

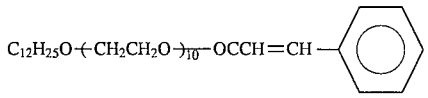
Q-2

$C_{18}H_{35}O(CH_2CH_2O)_{15}-O-CO-CH$
$C_{18}H_{35}O(CH_2CH_2O)_{15}-O-CO-CH$ Q-3

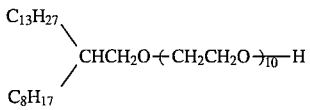
Q-4

-continued

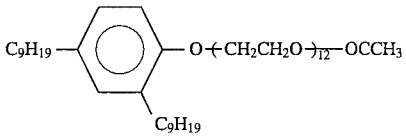
Q-5

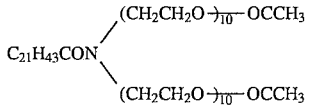
Q-6

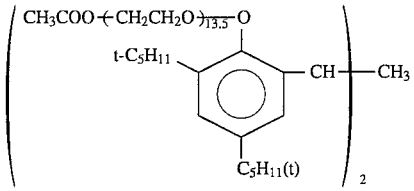
Q-7

The fluorine-containing series surface active agent for use in the present invention has a solubility of 0.01 weight % or less at 35° C. in a developing solution, a fixing solution and water which are used for processing the photographic material.

The fluorine-containing surface active agent for use in the present invention is not particularly limited so long as the solubility thereof falls within the above described range. Preferred are anionic, cationic, betainic and nonionic compounds each having an alkyl group, an alkenyl group or an allyl group each having 4 or more carbon atoms and partially or wholly substituted with fluorine, and more preferred are anionic, cationic, betainic and nonionic compounds each having perfluoroalkyl, perfluoroalkenyl, or perfluoroallyl substituents each having 6 or more carbon atoms.

Specific non-limiting examples of the fluorine-containing surface active agent for use in the present invention are shown below.

$C_8F_{17}SO_3K$ R-1

$C_{10}F_{21}COOK$ R-2

$C_{12}F_{25}COOK$ R-3

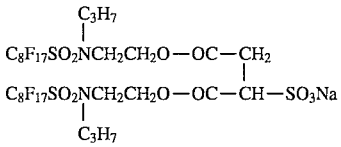
R-4

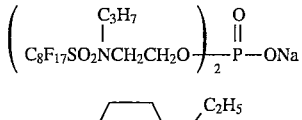
R-5

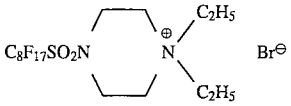
R-6

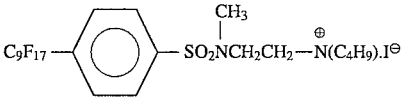
R-7

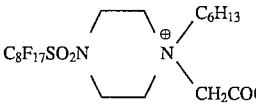
R-8

-continued

R-9

$$C_8F_{17}SO_2N(C_3H_7)(CH_2CH_2O)_{15}COCH_3$$

R-10

$$C_8F_{17}SO_2N(C_{12}H_{25})(CH_2CH_2O)_{15}H$$

The polyoxyethylene series surface active agent and fluorine-containing surface active agent for use in the present invention remain in the light-sensitive material upon processing because of the low solubilities thereof. These compounds are not eluted in a processing solution, and the use thereof in place of more soluble anti-static agents can reduce staining and foaming of the processing solutions.

The polyoxyethylene series surface active agent and fluorine-containing surface active agent for use in the present invention can be added to a silver halide emulsion layer or to at least one other layer constituting the photographic material including, for example, a surface protective layer, a back layer, an intermediate layer, and a subbing layer. Particularly preferred for addition of the surface active agents are a surface protective layer and a back layer.

Where the surface protective layer or back layer consists of two layers, the polyoxyethylene series surface active agent and the fluorine-containing surface active agent may be added to either (or both) of these layers, and the subject surface active agents can be added to a layer further overcoated onto the surface protective layer.

The content of the polyoxyethylene series surface active agent according to the present invention is preferably from 5 to 200 mg/m$^2$, more preferably 20 to 100 mg/m$^2$, and most preferably 30 to 70 mg/m$^2$ of the photographic material.

The content of the fluorine-containing surface active agent according to the present invention is preferably from 0.5 to 200 mg/m$^2$, more preferably 1 to 100 mg/m$^2$, and most preferably 1 to 60 mg/m$^2$.

The polyoxyethylene series surface active agent and fluorine-containing surface active agent according to the present invention each may be used either singly or in combination of two or more kinds thereof.

The polyoxyethylene series surface active agent and fluorine-containing surface active agent for use in the present invention may be dissolved in a water miscible organic solvent for addition to a coating solution, and then coated to incorporate the same into a light-sensitive material. Useful water miscible organic solvents include methanol, ethanol, isopropanol, formaldehyde, dimethylformamide, dimethylsulfoxide, methyl cellosolve and acetone. The water miscible solvent may be a mixed solution with water in some cases. Furthermore, the polyoxyethylene series surface active agent and fluorine-containing surface active agent according to the present invention may be dissolved or dispersed by using the aqueous solutions of other water soluble surface active agents. In this case, the surface active agent for use in the present invention may be dissolved in advance in a low boiling point organic solvent in some cases and then dispersed. Useful low boiling point solvents include formic acid, acetic acid, oxalic acid, maleic acid, alkyl (methyl, ethyl and propyl) ester of carbonic acid, etc., aryl ester, methylene chloride, chloroform, tetrahydrofuran, and diethyl ether.

Conventionally known surface active agents can be utilized as a water soluble surface active agent as the dispersant. Preferred compounds are shown below.

S-1

$$C_{12}H_{25}OSO_3Na$$

S-2

$$C_{17}H_{33}CON(CH_3)CH_2CH_2SO_3Na$$

S-3

$$(C_4H_9)_2CHCH_2OCO-CH_2-CH(C_4H_9)CH_2OCO-CH(C_4H_9)-SO_3Na$$

S-4

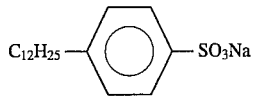

S-5

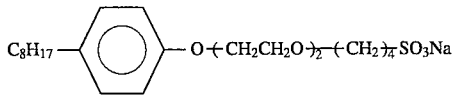

S-6

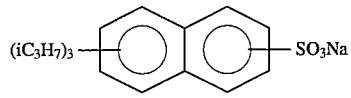

S-7

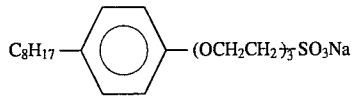

The addition amount of these water-soluble dispersants is preferably in the range of 0.5 to 100 weight % based on the total amount of the solid content of the polyoxyethylene series surface active agent or fluorine-containing surface active agent according to the present invention.

Other additives for use in the photographic material of the present invention are described in the patent publications shown below.

| Item | Corresponding portion |
|---|---|
| 1) Color tone improving agent | Left lower column, line 7 at p. 2 to left lower column, line 20 at p. 10 of JP-A-62-276539, and left lower column, line 15 at p. 6 to right upper column, line 19 at p. 11 of JP-A-3-94249. |
| 2) Matting agent, sliding agent, & plasticizer | Left upper column, line 10 to right upper column, line 10 at p. 12 and left lower column, line 10 to right lower column, line 1 at p. 14 of JP-A-2-68539. |
| 3) Hydrophilic colloid | Right upper column, line 11 to left lower column, line 16 at p. 12 of JP-A-2-68539. |
| 4) Hardener | Left lower column, line 17 at p. 12 to right upper column, line 6 at p. 13 of JP-A-2-68539. |
| 5) Polyhydroxybenzenes | Left upper column at p. 11 to left lower column at p. 12 of JP-A-3-39948, and EP Patent 452772A. |
| 6) Layer structure | JP-A-3-198041 |

The developing agent preferably used for the developing solution of the present invention is a dihydroxybenzene series developing agent. Useful dihydroxybenzene series developing agents include hydroquinone, chlorohydroquinone, bromohydroquinone, isopropylhydroquinone, methylhydroquinone, 2,3-dichloropropylhydroquinone, hydroquinone, 2,5-dichlorohydroquinone, 2,3-dibromorohydroquinone, 2,5-dimethylhydroquinone, and potassium hydroquinonemonosulfonate, and hydroquinone is particularly preferred. The developing agent concentration is preferably in the range of 0.05 to 0.8 mol/liter of the developing solution.

In the present invention, 1-phenyl-3-pyrazolidones or p-aminophenols are particularly preferably used together with the above noted dihydroxybenzene series developing agent.

Useful 1-phenyl-3-pyrazolidones include 1-phenyl-3-pyrazolidone, 1-phenyl-4,4-dimethyl-3-pyrazolidone, 1-phenyl-4-methyl-4-hydroxymethyl-3-Pyrazolidone, 1-phenyl- 4,4-dihydroxymethyl-3-pyrazolidone, and 1-phenyl-5-methyl-3-pyrazolidone.

Useful p-aminophenols include N-methyl-p-aminophenol, N-(β-hydroxyethyl)-p-aminophenol, N-(4-hydroxyphenyl)glycine, 2-methyl-p-aminophenol, and p-benzylaminophenol. Of these, N-methyl-p-aminophenol is preferred.

When the dihydroxybenzene series developing agent and an auxiliary developing agent such as a 1-phenyl-3pyrazolidone or a p-aminophenol are used in combination, the former is preferably used in an amount of 0.05 to 0.5 mol/liter and the latter in an amount of 0.001 to 0.06 mol/liter (particularly 0.003 to 0.06 mol/liter).

The concentration of bromide ion in the developing solution of the present invention is preferably 0.012 mol/liter or less, so as not to inhibit rapid development of the high silver chloride content photographic material. The lower limit of the bromide ion concentration is preferably 0.0004 mol/liter or more, more preferably 0.001 mol/liter or more, because the suitable presence of bromide ion can reduce fog. On the other hand, the concentration of bromide ion in a conventional developing solution for medical use is 0.016 mol/liter or more.

Sulfite may be added to the developing solution according to the present invention.

Examples of the sulfite include sodium sulfite, potassium sulfite, lithium sulfite, ammonium sulfite, sodium bisulfite, potassium metabisulfite, and formaldehyde sodium bisulfite. The addition amount of sulfite is preferably from 0.01 mol/liter to and 0.8 mol/liter.

An amino compound may be incorporated into the developing solution for use in the present invention to promote development. In particular, useful amino compounds include those described in JP-A-56-106244, JP-A-61-267759 and JP-A-2-208652.

The pH of the developing solution for use in the present invention is preferably 10.8 or lower, more preferably 9.8 or lower. A conventional water soluble inorganic alkali metal salt (for example, sodium hydroxide and sodium carbonate) can be used to adjust the pH value.

In addition thereto, the developing solution and replenisher thereof according to the present invention may further contain a pH buffer agent such as boric acid, borax, secondary sodium phosphate, secondary potassium phosphate, primary sodium phosphate, and primary potassium phosphate, in addition to the pH buffer agents described in JP-A-60-93433; a development inhibitor such as potassium bromide and potassium iodide; and an organic solvent such as dimethylformamide, methyl cellosolve, hexylene glycol, ethanol, and methanol. Benzotriazole derivatives for addition to the developing solution include 5-methylbenzotriazole, 5-bromobenzotriazole, 5-chlorobenzotriazole, 5-butylbenzotriazole, and benzotriazole. Particularly preferred is 5-methylbenzotriazole. Nitroindazoles for addition to the developing solution include 5-nitroindazole, 6-nitroindazole, 4-nitroindazole, 7-nitroindazole, and 3-cyano-5-nitroindazole. Particularly preferred is 5-nitroindazole. Particularly when a compound such as 5-nitroindazole is used, it is generally dissolved in advance (for preparing the developer) in a part different from the part containing a dihydroxybenzene series developing agent and a sulfite preservative and then both the parts are mixed in use, followed by adding water. Furthermore, alkalization of the part in which 5-nitroindazole is dissolved colors the part to yellow for convenience of handling.

Furthermore, the developing solution may contain a color toning agent, a surface active agent, a hard-water softener, and a hardener as needed.

Useful chelating agents for addition to the developing solution include ethylenediamineorthohydroxyphenylacetic acid, diaminopropanetetraacetic acid, nitrilotriacetic acid, hydroxyethylethylenediaminetriacetic acid, dihydroxyethyl glycine, ethylenediaminediacetic acid, ethylenediaminedipropionic acid, iminodiacetic acid, diethylenetriaminepentaacetic acid, hydroxyethyliminodiacetic acid, 1,3-diaminopropanoltetraacetic acid, triethylenetetraminehexaacetic acid, transcyclohexanediaminetetraacetic acid, ethylenediaminetetraacetic acid, glycol ether diaminetetraacetic acid, ethylenediaminetetrakismethylenephosphonic acid, diethylenetriaminepentamethylenephosphonic acid, nitrilotrimethylenephosphonic acid, 1-hydroxyethylidene-1,1-diphosphonic acid, 1,1-diphosphonoethane-2-carboxylicacid, 2-phosphonobutane-1,2,4-tricarboxylic acid, 1-hydroxy-l-phosphonopropane-1,3,3-tricarboxylic acid, catechol-3,5-disulfonic acid, sodium pyrophosphate, sodium tetra-polyphosphate, and sodium hexametaphosphate. Particularly preferred are, for example, diethylenetriaminepentaacetic acid, triethylenetetraminehexaacetic acid, 1,3-diaminopropanoltetraacetic acid, glycol ether diaminetetraacetic acid, hydroxyethylethylenediaminetriacetic acid, 2-phosphonobutane-1,2,4-tricarboxylic acid, 1,1-diphosphonoethane-2-carboxylic acid, nitrilotrimethylenephosphonic acid, ethylenediaminetetraphosphonic acid, diethylenetriaminepentaphosphonicacid, 1-hydroxypropylidene-1,1-diphosphonic acid, 1-aminoethylidene-1,1-diphosphonic acid, 1-hydroxyethylidene-1,1-diphosphonic acid, and the salts thereof.

The above chelating agents are used in an amount of $2.5\times10^{-4}$ to $5\times10^{-2}$ mol per liter of the developing solution.

The compounds described in JP-B-62-4702 and 62-703, and JP-A-1-200249, Japanese Patent application Nos. 3-94955, 3-112275, and 3-233718 can be added to the developing solution of the present invention for preventing silver stain.

In addition thereto, a dialdehyde series hardener or bisulfite adduct thereof may be incorporated into the developing solution of the present invention. Useful examples thereof include glutaraldehyde, α-methylglutaraldehyde, β-methylglutaraldehyde, maleindialdehyde, succinedialdehyde, methoxysuccinedialdehyde, methylsuccinedialdehyde, α-methoxy-β-ethoxyglutaraldehyde, α-n-butoxyglutaraldehyde, α,α-dimethoxysuccinedialdehyde, β-isopropylsuccinedialdehyde, α,α-diethylsuccinedialdehyde, butylmaleindialdehyde, and the bisulfite adduct thereof. The dialdehyde compound is used in such amount that the sensitivity of a photographic layer to be processed is not depressed and the drying time is not markedly extended. The addition amount thereof is generally 1 to 50 g, preferably 3 to 10 g per liter of the developing solution. Of these, glutaraldehyde or the bisulfite adduct thereof is most generally used.

Where a bisulfite adduct of the dialdehyde series hardener is used, the bisulfite of this adduct is included in the sulfite content of the developing solution.

In addition thereto, the developing solution additives described in *Photographic Processing Chemistry* written by L. F. A. Maison, pp. 226 to 229, published by Focal Press Co., Ltd. (1966), U.S. Pat. Nos. 2,193,015 and 2,592,364, and JP-A-48-64933 may also be used.

In the present invention, development processing is carried out while replenishing the developing solution in an amount of preferably 200 ml or less, particularly preferably 50 to 200 ml per $m^2$ of light-sensitive material processed.

A solution having the same composition as that of the above developing solution may be used as the developing solution loaded into an automatic developing machine at an initial stage of processing, or a solution having a partially changed composition may be used.

The fixing solution for use in the present invention is an aqueous solution containing thiosulfate, and has pH of generally 3.8 or more, preferably 4.2 to 6.0.

Sodium thiosulfate and ammonium thiosulfate are available as the fixing agent. The amount of the fixing agent can be suitably selected, and is generally about 0.1 to about 3 mol/liter.

The fixing solution may contain a water soluble aluminum salt as a hardener. For example, aluminum chloride, aluminum sulfate, and potassium alum are useful hardeners.

Tartaric acid, citric acid and gluconic acid can be added to the fixing solution singly or in combination of two or more kinds thereof. The fixing solution containing these compounds in an amount of 0.005 mol or more per liter is effective, and particularly effective is a fixing solution containing these compounds in an amount of 0.01 to 0.03 mol/liter.

The fixing solution can contain a preservative (for example, sulfite and bisulfite), a pH buffer agent (for example, acetic acid and boric acid), a pH adjusting agent (for example, sulfuric acid), a chelating agent having a hard-water softening ability, and the compounds described in JP-A-62-78551.

In the present invention, fixing processing is carried out while replenishing the above fixing solution in an amount of preferably 200 ml or less, particularly preferably 50 to 200 ml per $m^2$ of light-sensitive material processed.

In the above processing method according to the present invention, a light-sensitive material is processed in a rinsing water or a stabilizing solution and then dried after the developing and fixing steps.

Various types of processing equipment such as a roller transport type and a belt transport type automatic developing machine can be used in the present invention, and an automatic developing machine of the roller transport type is preferred. Further, the automatic developing machines having a developing tank with a small aperture rate (i.e., a small opening ratio) as described in JP-A-1-166040 and JP-A-1-193853 can be used to enable operation in which air oxidation and evaporation are decreased. In this case, the developer is stable to a change in processing environment, and the replenishing amount can be further reduced.

A countercurrent system containing e.g., 2 stages or 3 stages has been employed to reduce the replenishing amount of rinsing water. Application of this countercurrent system to the present invention enables further efficient processing because the light-sensitive material is processed in progressively cleaner rinsing tanks to thereby reduce staining from the fixing solution.

In the above water saving processing and nonpiping processing, a preservative treatment is preferably provided to the rinsing water or stabilizing solution.

The preservative treatment can comprise the UV irradiation method described in JP-A-60-263939, the method using a magnetic field as described in JP-A-60-263940, the method in which an ion exchange resin is used to prepare pure water as described in JP-A-61-131632, and the method in which a fungicide is used as described in JP-61-115154, JP-A-62-153952, JP-A-62-220951 and JP-A-62-209532.

Furthermore, there can be used in combination the fungicides, anti-mold agents and surface active agents described in L. F. West, *Water Quality Criteria* Photo. Sci. & Eng. vol. 9, No. 6 (1965), M. W. Beach, *Microbiological Growths in Motion-Picture Processing* SMPTE Journal vol. 85 (1976), R. D. Deegan, *Photo Processing Wash Water Biocides* J. Imaging Tech, vol. 10, No. 6 (1984), and JP-A-57-8542, JP-A-57-58143, JP-A-58-105145, JP-A-57-132146, JP-A-58-18631, JP-A-57-97530, and JP-A-57-157244.

Furthermore, there can be used in combination as a microbicide for the rinsing bath or stabilizing bath the isothiazoline series compounds described in *J. Image Tech.* written by R, T. Kreiman, vol. 10, No. 6, pp. 242 (1984), the isothiazoline series compounds described in Research Disclosure (R.D.) vol. 205, No. 20526 (May 1981), the isothiazoline series compounds described in R. D. vol. 228, No. 22845 (April 1983), and the compounds described in JP-A-62-209532.

In addition to the above, the rinsing bath or stabilizing bath may contain the compounds described in *Anti-fungous and Anti-mold Chemistry* written by Hiroshi Horiguchi, Sankyo Publication (1982), and *Anti-fungous and Anti-mold Technical Handbook* Japan Anti-fungous and Anti-mold Association, Hakuhodo (1986).

When rinsing is carried out with a small amount (preferably 200 ml/$m^2$ or less) of rinsing water in the method according to the present invention, a squeeze roller rinsing bath is preferably provided as described in JP-A-63-18350. The constitution of the rinsing process described in JP-A-63-143548 is preferably employed.

Furthermore, a part or all of the overflow solution from the rinsing or stabilizing bath, which is generated by replenishing water provided with an anti-mold measure to a rinsing or stabilizing bath of the present invention, can be added to the processing bath having a fixing ability which precedes the rinsing bath or stabilizing bath, as described in JP-A-60-235133.

"Development process time" or "developing time" means the time from when the edge of the light-sensitive material to be processed is dipped into the developing tank solution of an automatic developing machine to the time when that same edge is dipped into the fixing solution which is the next processing bath in the processing sequence. "Fixing time" means the time from when the edge of the light-sensitive material is dipped in the fixing tank solution to the time when that same edge is dipped into the rinsing tank solution (or stabilizing solution) which is the next processing bath in the processing sequence. "Rinsing time" means the time during when the light-sensitive material is dipped into the rinsing tank solution.

"Drying time" means the time during when the light-sensitive material remains in a drying zone. A drying zone in which hot air of generally 35° to 100° C., preferably 40° to 80° C. is blown is usually part of the automatic developing machine.

In the development processing according to the present invention, the developing time is generally 5 to 30 seconds, preferably 7 to 17 seconds and the developing temperature is preferably 25° to 50° C., more preferably 30° to 40° C.

According to the present invention, the fixing temperature and time are preferably about 20° to about 50° C. and 5 to 30 seconds, more preferably 25° to 40° C. and 7 to 17 seconds, respectively. The fixing can be carried out within these ranges, and a sensitizing dye can be eluted to the extent to which residual color is not generated.

The temperature and time in a rinsing bath (or a stabilizing bath) are preferably 0° to 50° C. and 5 to 30 seconds, more preferably 15° to 40° C. and 7 to 17 seconds.

According to the method of the present invention, the light-sensitive material subjected to developing, fixing and rinsing (or stabilizing) is then dried via a squeeze roller (to remove the rinsing solution). The drying is carried out at about 40° to about 100° C. The drying time can be suitably selected depending on environmental conditions, and is usually about 5 to 40 seconds, particularly preferably about 5 to 30 seconds at 40° to 80° C.

When processing is carried out at 100 seconds or less (dry to dry) in the light-sensitive material/processing system according to the present invention, in order to prevent developing unevenness unique to rapid processing, preferably rollers of a rubber material are used as the rollers at the outlet of a developing tank as described in JP-A-63-151943; a discharge flow speed for stirring the developing solution in the developing tank is set at 10 m/minute or more as described in JP-A-63-151944; and more vigorous stirring during operation (as opposed to standby) is employed at least during development processing as described in JP-A-63-264758. To further reduce the processing time, opposed rollers may be employed in the fixing tank in order to accelerate fixing speed. Use of the opposed rollers can reduce the number of rollers and decrease the size of the processing tank. In this manner, the automatic developing machine may be made more compact.

The present invention will be explained below with reference to the following Examples, but is not limited thereby.

EXAMPLES

Example 1

1. Preparation of the silver halide emulsions a) Preparation of the silver halide emulsion A:

32 g of gelatin was added to distilled water 900 ml and dissolved at 40° C. The pH was then adjusted to 3.8 with sulfuric acid, followed by adding 3.3 g of sodium chloride. Added and mixed with the above solution were a solution prepared by dissolving 32 g of silver nitrate in 200 ml of distilled water and a solution prepared by dissolving 11 g of sodium chloride and $K_2IrCl_6$ in an amount of $1\times10^{-7}$ mol per mol of finished silver halide (amount of silver halide contained in the finally prepared emulsion) in distilled 200 ml of water at 40° C. over a period of 2 minutes. Furthermore, a solution prepared by dissolving 6.4 g of silver nitrate in 280 ml of distilled water and a solution prepared by dissolving 21.6 g of sodium chloride in 275 ml of distilled water were added and mixed at 40° C. over a period of 5 minutes. Subsequently, added and mixed thereto were a solution prepared by dissolving 64 g of silver nitrate in 280 ml of distilled water and a solution prepared by dissolving 22.4 g of sodium chloride and $K_4Fe(CN)_6 3H_2O$ in an amount of $1\times10^{-4}$ mol per mol of silver halide in 285 ml of distilled water at 40° C. over a period of an additional 5 minutes.

The emulsion thus-obtained was observed with an electron microscope and found to consist of cubic grains having a projected area circle-corresponding diameter of about 0.21 μm and a fluctuation coefficient of 9.8% in grain size distribution.

After this emulsion was desalted, 72 g of gelatin and 2.6 g of phenoxyethanol were added thereto. Then, the pH was adjusted to 6.7 and the pAg was controlled to 7.9 with sodium chloride. Chemical sensitization was carried out at 58° C. in the following order. First, a monodispersed silver bromide emulsion having an average grain size of 0.05 μm was added in a proportion corresponding to 1.1 mol % in terms of total silver halide and then there were added 7.2 mg of compound (1), 9.2 mg of chlorauric acid, 1.3 mg of triethylthiourea, 0.72 mg of the selenium sensitizer (A), and 0.29 g of nucleic acid. Finally, 4-hydroxy-6-methyl-1,3,3a,7-tetrazaindene (162 mg) was added, and the emulsion was rapidly cooled to solidify the same, to thereby obtain emulsion A.

Compound (1)

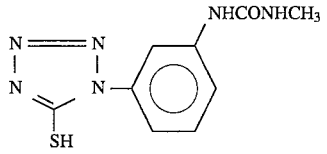

Selenium sensitizer (A)

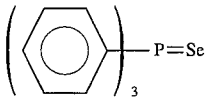

2. Preparation of the emulsion layer coating solutions:

The following compounds per mol of silver halide were added to Emulsion A to prepare the emulsion layer coating solutions.

Composition of the emulsion layer coating solution:

| | |
|---|---|
| a. Spectral sensitizing dye (2) | $5.5\times10^{-5}$ mol |
| b. Supersensitizer (3) | $3.3\times10^{-4}$ mol |
| c. Polyacrylamide (molecular weight: 40,000) | 9.2 g |
| d. Trimethylolpropane | 1.4 g |
| e. Poly(ethyl acrylate/methacrylic acid) latex | 22 g |
| Spectral sensitizing dye (2) | |

-continued

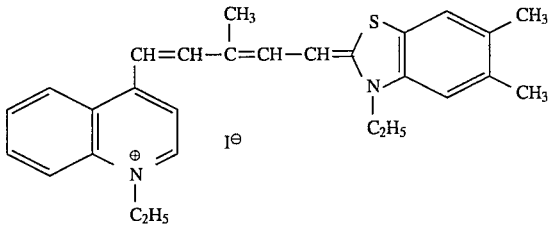

Supersensitizer (3)

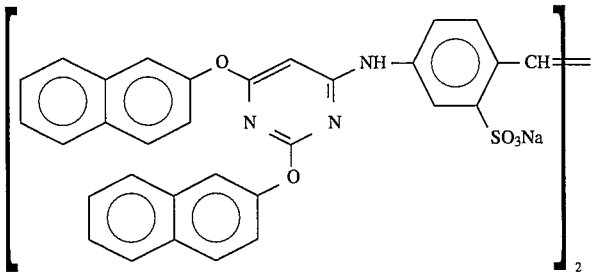

3. Preparation of the surface protective layer coating solution for the emulsion layer:

A vessel was heated to 40° C. and the following compounds were added to prepare the coating solution.

| | |
|---|---|
| a. Gelatin | 100 g |
| b. Polyacrylamide (molecular weight: 40,000) | 12.3 g |
| c. Poly(sodium styrenesulfonate) (molecular weight: 600,000) | 0.6 g |
| d. Polymethyl methacrylate fine grains (average grain size: 2.5 μm) | 2.7 g |
| e. Poly(sodium acrylate) | 3.7 g |
| f. Sodium t-octylphenoxyethoxyethane sulfonate | 1.5 g |
| g. Compound and amount described in Table 1 | |
| h. Compound R-1 | 84 mg |
| i. Compound R-4 | 84 mg |
| j. NaOH | 0.2 g |
| k. Methanol | 78 ml |
| l. 1,2-Bis(vinylsulfonylacetoamide) ethane | * |
| m. Compound (4) | 52 mg |

-continued

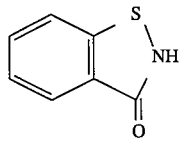

*controlled so that the amount thereof was 2.5% by weight based on the entire amount of gelatin contained in the emulsion layer and surface protective layer.

4. Back conductive layer:

| | |
|---|---|
| a. Gelatin | 50 g |
| b. Compound and amount described in Table 1 | |

5. Preparation of the back layer coating solution:

A vessel was heated to 40° C. and the following compounds were added to prepare the back layer coating solution.

| | |
|---|---|
| a. Gelatin | 50 g |
| b. Dye (A) | 2.38 g |

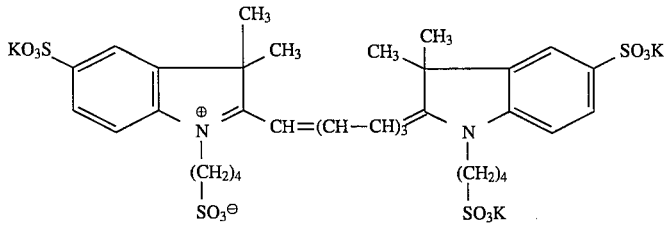

| | |
|---|---|
| c. Poly(sodium styrenesulfonate) | 1.1 g |
| d. Phosphoric acid | 0.55 g |
| e. Poly(ethyl acrylate/methacrylic acid) latex | 2.9 g |
| f. Compound (4) | 46 mg |
| g. Oil dispersion of Dye (B) described in JP-A-61-285445 (as the dye itself) Dye (B) | 246 mg |

-continued

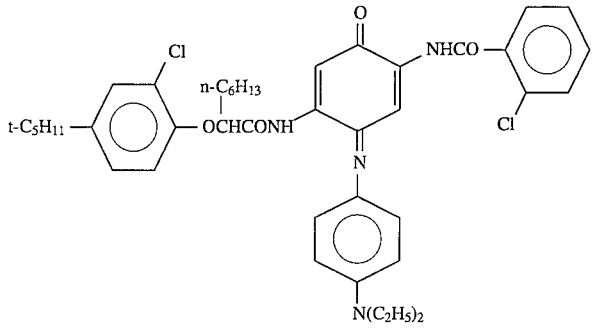

h. Oligomer surface active agent dispersion of Dye (C) (as the dye itself) described in JP-A-62-275639 — 46 mg Dye (C)

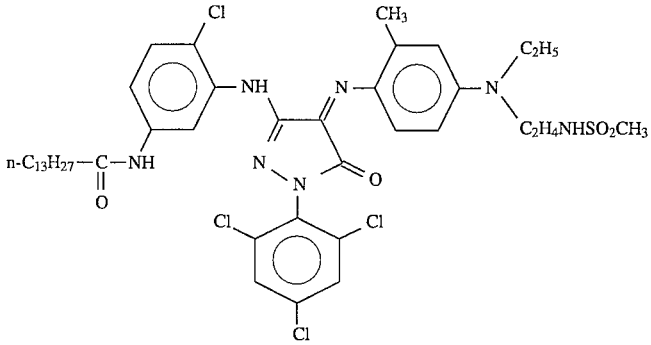

6. Preparation of the surface protective layer coating solution for the back layer:

A vessel was heated to 40° C. and the following compounds were added to prepare the coating solution.

| | |
|---|---|
| a. Gelatin | 100 g |
| b. Poly(sodium styrenesulfonate) | 0.3 g |
| c. Polymethyl methacrylate fine grains (average grain size: 3.5 μm) | 4.3 g |
| d. Sodium t-octylphenoxyethoxyethane sulfonate | 1.8 g |
| e. Poly(sodium acrylate) | 1.7 g |
| g. Compound and amount described in Table 1 | |
| h. Compound R-1 | 268 mg |
| i. Compound R-4 | 45 mg |
| J. NaOH | 0.3 g |
| k. Methanol | 131 ml |
| l. 1,2-Bis(vinylsulfonylacetoamide) ethane | * |
| m. Compound (4) | 45 mg |

*controlled so that the amount thereof was 2.2% by weight based on the entire amount of gelatin contained in the emulsion layer and surface protective layer.

7. Preparation of the photographic material

The above described back conductive layer and back layer coating solutions were coated on one side of a blue colored polyethylene terephthalate support together with the surface protective layer coating solution for the back layer. The gelatin coating amounts of the back conductive layer and back layer were each 1.35 g/m$^2$, and the gelatin coating amount of the surface protective layer for the back layer was 1.13 g/m$^2$.

Subsequently, the above described emulsion layer coating solution and surface protective layer coating solution were coated onto the opposite side of the support so that the coated Ag amount was 1.85 g/m$^2$ and the gelatin coating amounts of the emulsion layer and surface protective layer were 1.6 g/m$^2$ and 1.23 g/m$^2$, respectively, to thereby prepare photographic materials 1 to 7.

8. Preparation of the developing solution:

| | |
|---|---|
| Potassium hydroxide | 23 g |
| Sodium sulfite | 35 g |
| Potassium sulfite | 44 g |
| Diethylenetriaminepentaacetic acid | 2 g |
| Boric acid | 10 g |
| Potassium carbonate | 13 g |
| Hydroquinone | 35 g |
| Diethylene glycol | 50 g |
| 4-Hydroxymethyl-4-methyl-1-phenyl-3-pyrazolidone | 4 g |
| 5-Methylbenzotriazole | 0.06 g |
| 2,3,5,6,7,8-Hexahydro-2-thioxo-4(1H)-quinazolinone | 0.1 g |
| Sodium 2-mercaptobenzimidazole-5-sulfonate | 0.14 g |
| Potassium bromide | 1 g (0.0084 mol) |
| Water to make | 1000 ml |
| (pH was adjusted to | 10.55) |

9. Preparation of the fixing solution:

| | |
|---|---|
| Ammonium thiosulfate | 140 g |
| Sodium sulfite | 15 g |
| Disodium ethyelenediaminetetraacetate dihydrate | 25 mg |
| Sodium hydroxide | 6 g |
| Water to make | 1000 ml |
| (pH was adjusted to | 5.10) |

10. Evaluation of staining due to the processing solutions:

Photographic materials 1 to 7 were stored for 7 days after coating at 25° C. and 65% RH, and then subjected to scanning exposure with a semiconductor laser of 780 nm for $10^{-7}$ second to provide a density after development processing of 1.0. Four hundred (400) sheets (size: 25.7 cm×36.4 cm) of the respective photographic materials were similarly exposed. After exposure, the 400 sheets of each of Photographic materials 1 to 7 were subjected to the processing of 30 seconds including fixing, rinsing and drying with an automatic developing machine ("FPM-2000" manufactured by Fuji Photo Film Co., Ltd.) in which the driving motor and gear were modified to accelerate the transporting speed. The processing temperature was 35° C.

The evaluation of processing solution stain was classified according to the following three grades:

G: stain of the processing solution was scarcely observed in the developing solution and/or fixing solution;

M: scurf-like stain and foaming of the processing solution were slightly observed in the developing solution and/or fixing solution, but at a level acceptable for practical use; and B: scurf-like stain and foaming were extensively observed in the developing solution and/or fixing solution at a level causing problems in practical use.

11. Evaluation of static marks:

The unexposed photographic materials adjusted to a humidity at 25° C. and 10% RH for 2 hours and were rubbed with the roller of a urethane rubber in a dark room at the same air condition (in order to confirm the generation of static marks).

The evaluation of the generation of static marks (after development) was classified according to the following 3 grades:

A: generation of static marks was not entirely observed;

B: some static marks were observed; and

C: static marks were observed at an unacceptably high level.

The results obtained are shown in Table 1.

It is clearly seen from the results in Table 1 that the present invention effectively reduces processing stain and static marks.

Example 2

Photographic materials 8 and 9 were prepared in the same manner as Photographic materials 5 and 6 in Example 1, except that the back conductive layer was replaced with the following first subbing layer and second subbing layer.

First subbing layer:

The first subbing layer of the following composition was provided on a biaxially oriented polyethylene terephthalate film with a thickness of 180 μm subjected to corona discharge treatment by a wire bar coater system.

| | |
|---|---|
| Butadiene-styrene copolymer latex (butadiene/styrene weight ratio = 31/69) | 322 mg/m$^2$ |
| Sodium 2,4-dichloro-6-hydroxy-s-triazine | 8.4 mg/m$^2$ |

Second subbing layer:

Next, a second subbing layer having the following composition was provided on the first subbing layer with a wire bar coater system.

| | |
|---|---|
| Gelatin | 160 mg/m$^2$ |
| Matting agent (polymethyl methacrylate having an average particle size of 2.5 μm) | 2.5 mg/m$^2$ |
| $SnO_2/Sb_2O_3$ = 9:1 | 216 mg/m$^2$ |

The processing and evaluation of processing stain and static marks were carried out in the same manner as in Example 1, except that the developing solution was replaced with the following.

TABLE 1

| | Photographic material No. | | | | | | |
|---|---|---|---|---|---|---|---|
| | 1 (Comp.) | 2 (Comp.) | 3 (Inv.) | 4 (Inv.) | 5 (Inv.) | 6 (Inv.) | 7 (Inv.) |
| Surface protective layer for emulsion layer | | | | | | | |
| Compound | None | A | Q-1 | Q-5 | Q-1 | Q-1 | Q-1 |
| Coated amount | — | 50 mg/m$^2$ | 40 mg/m$^2$ | 40 mg/m$^2$ | 40 mg/m$^2$ | 40 mg/m$^2$ | 40 mg/m$^2$ |
| Back conductive layer | | | | | | | |
| Compound | None | None | None | None | * | ** | None |
| Coated amount | — | — | — | — | 0.25 g/m$^2$ | 0.25 g/m$^2$ | — |
| Surface protective layer for back layer | | | | | | | |
| Compound | None | A | Q-1 | Q-5 | None | None | * |
| Coated amount | — | 50 mg/m$^2$ | 40 mg/m$^2$ | 40 mg/m$^2$ | — | — | 0.25 g/m$^2$ |
| Evaluation of processing stain | | | | | | | |
| Replenishing amount*** | | | | | | | |
| 320 ml/m$^2$ | G | M | G | G | G | G | G |
| 190 ml/m$^2$ | G | B | M | M | G | G | G |
| Static mark generation | C | A | A | A | A | A | A |

*$SnO_2/Sb_2O_3$ = 9/1 (by weight)
**$In_2O_3/Sb_2O_3$ = 9/1 (by weight)
***Replenishing amount of developing solution/fixing solution
Compound A: $C_{18}H_{37}O\text{-}(CH_2CH_2O)_{15}H$ Developing solution:

| | |
|---|---|
| Hydroquinone | 20.0 g |
| 1-Phenyl-4-methyl-4-hydroxymethyl-3-pyrazolidone | 2.0 g |
| Sodium sulfite | 35.0 g |
| Potassium carbonate | 25.0 g |
| Diethylenetriaminepentaacetic acid | 2.0 g |
| Diethylene glycol | 20.0 g |
| Boric acid | 9.0 g |
| 5-Methylbenzotriazole | 0.1 g |
| Potassium bromide | 0.6 g (0.005 mol) |
| Water to make | 1 liter |
| pH was adjusted with potassium hydroxide to | 9.50 |

The results obtained were the same as those of Photographic materials 5 and 6 in Example 1. It was found that replacement of the back conductive layer with the above described subbing layers provided a similar effect.

While the invention has been described in detail and with reference to specific embodiments thereof, it will be apparent to one skilled in the art that various changes and modifications can be made therein without departing from the spirit and scope thereof.

What is claimed is:

1. A method for forming an image comprising processing an imagewise exposed X-ray black-and-white silver halide photographic material for a laser scanner comprising a transparent support having thereon at least one silver halide emulsion layer comprising a silver halide emulsion having a silver chloride content of 90 mol % or more spectrally sensitized to a wavelength range of 600 nm or more, and the processing comprises developing in a developing bath and fixing in a fixing bath, wherein the photographic material comprises a conductive metal oxide in the amount of from 0.00051 g/m$^2$ or more, and the conductive metal oxide is selected from the group consisting of ZnO containing at least one of Al and In as a donor to the ZnO, $SnO_2$ containing at least one of Sb and Nb as a donor to the $SnO_2$, and $TiO_2$ containing at least one of Nb and Ta as a donor to the $TiO_2$, and wherein the donor is present in an amount of 0.01 to 30 mol %, gelatin is coated on a silver halide emulsion layer-containing side of the support in a total amount of 1 to 3.0 g/m$^2$ and Ag is present in the silver halide emulsion in a coated amount per each side of the support of 2.6 g/m$^2$ or less; the developing bath and the fixing bath are each replenished in an amount of from 50 to 200 ml per m$^2$ of the photographic material processed; and the processing is carried out in an automatic developing machine.

2. The method as in claim 1, wherein the silver halide emulsion contains silver bromochloride having a silver chloride content of 96 mol % or more or silver chloride.

3. The method as in claim 1, wherein the silver halide grains of the silver halide emulsion having a silver chloride content of 90 mol % or more comprise a localized silver bromide phase having a silver bromide content of from 10 to 95 mol %.

4. The method as in claim 1, wherein the silver halide emulsion having a silver chloride content of 90 mol % or more comprises silver halide grains having a (100) face/(111) face ratio of 5 or more in a proportion of 50 wt % or more of the silver halide grains constituting the emulsion.

5. The method as in claim 1, wherein the silver halide grains constituting the silver halide emulsion having a silver chloride content of 90 mol % or more have a grain size of not larger than 0.4 μm.

6. The method as in claim 1, wherein the silver halide emulsion having a silver chloride content of 90 mol % or more is spectrally sensitized with a spectral sensitizing dye having a maximum wavelength sensitivity of 600 nm or more in an amount of from $1\times10^{-7}$ to $1\times10^{-2}$ mol per mol of silver halide.

7. The method as in claim 1, wherein the coated Ag amount of all of the silver halide emulsions present in the photographic material is 2.6 g/m$^2$ or less per each side of the support.

8. The method as in claim 1, wherein the conductive metal oxide has an oxygen deficiency.

9. The method according to claim 1, wherein the donor is present in an amount of 0.1 to 10 mol %.

* * * * *